United States Patent [19]

Canalini et al.

[11] 3,995,490

[45] Dec. 7, 1976

[54] METHOD AND APPARATUS FOR THE CONTINUOUS MONITORING OF A CONTINUOUS METALLURGICAL PROCESS

[75] Inventors: Donatello Canalini, Vitinia (Rome); Eugenio Repetto, Rome, both of Italy

[73] Assignee: Centro Sperimentale Metallurgico S.p.A., Rome, Italy

[22] Filed: Oct. 14, 1975

[21] Appl. No.: 662,179

[30] Foreign Application Priority Data

Oct. 11, 1974 Italy ..... 53487/74

[52] U.S. Cl. ..... 73/340; 73/295; 164/4; 164/155

[51] Int. Cl.[2] ..... B22D 11/12; G01F 23/24

[58] Field of Search ..... 73/295, 340–342, 73/359; 164/4, 154, 155

[56] References Cited

UNITED STATES PATENTS

| | | | |
|---|---|---|---|
| 3,204,460 | 9/1965 | Milnes | 73/295 |
| 3,358,743 | 12/1967 | Adams | 164/154 |
| 3,456,714 | 7/1969 | Weiss | 164/154 |
| 3,456,715 | 7/1969 | Freedman et al. | 164/155 |
| 3,797,310 | 3/1974 | Babcock et al. | 73/295 |
| 3,864,973 | 2/1975 | Petry | 73/295 |
| 3,923,091 | 12/1975 | Dorr et al. | 164/4 |

*Primary Examiner*—Richard C. Queisser
*Assistant Examiner*—John S. Appleman
*Attorney, Agent, or Firm*—Young & Thompson

[57] ABSTRACT

A continuous metallurgical process such as electroslag refining or continuous casting is continuously monitored by surrounding the area of the melt with a hollow sleeve that contains a continuous helical passageway through which a coolant is continuously passed. The temperature of the coolant is continuously monitored at a plurality of points spaced apart axially of the sleeve, thereby to determine not the temperature of the adjacent metal or slag, but rather the quantity of heat transmitted by that adjacent metal or slag. In this way, the location of the solid metal, the molten metal and the slag, as well as other useful parameters, can be continuously monitored.

8 Claims, 1 Drawing Figure

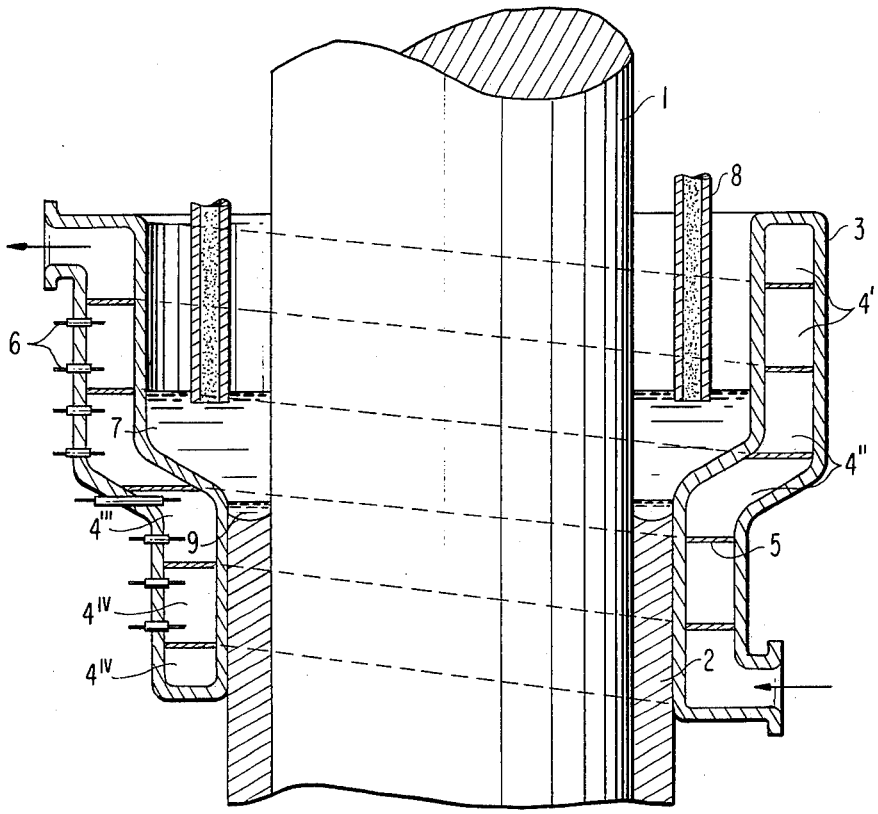
1
8
3
4'
6
7
4"
4'''
9
5
4IV
4IV
2

METHOD AND APPARATUS FOR THE CONTINUOUS MONITORING OF A CONTINUOUS METALLURGICAL PROCESS

The present invention relates to a method and apparatus for the continuous monitoring of a continuous metallurgical process, such as electroslag remelting of metals (hereinafter ESR) or continuous casting.

In the field of continuous metallurgical processes, it is necessary to monitor continuously a number of process parameters thereby to exert optimum control over the process. Heretofore, each parameter to be monitored has had its own particular device for that purpose, for example, for monitoring and controlling the power delivered by the electrode in ESR, or the voltage or intensity of current, or the level of liquid metal in an ingot mold.

According to the prior art, the level of a liquid metal can be monitored by placing a row of thermocouples parallel to the axis of, for example, an ingot mold, in contact with the wall of the ingot mold close to the ingot produced. An abrupt variation in temperature occurs at the level of the surface of the liquid metal.

It is also known, as in U.S. Pat. No. 3,797,310, to position a series of metal probes in contact with the ingot mold wall close to the object to be produced. The probes and the ingot mold are of different metals, so that the junction between the probe and the mold constitutes a thermocouple.

These known methods and apparatus suffer from two basic disadvantages: they measure temperature at a series of isolated points; and they measure a parameter (namely, temperature) that is of only secondary interest in the smelting process. Thus, the measurement of temperature per se is not really useful, because the temperature at any given point may at any time be anomalous for any of a number of reasons: local variations in temperature may occur which give no useful information and which in fact distort the picture of the smelting operation which would otherwise be provided. The second disadvantage is that the temperature as such is only a secondary manifestation of the amount of heat emitted by the metal and/or slag, and may vary according to a number of factors unrelated to that amount of heat.

Also, it is quite costly to install and monitor a number of devices each peculiar to its own parameter.

Accordingly, it is an object of the present invention to provide a method and apparatus for the continuous monitoring of a continuous metallurgical process, which will provide information indicative of a sufficient number of parameters of the process to permit a complete control of the metallurgical process.

Another object of the present invention is the provision of such a method and apparatus, which will permit simultaneously the monitoring of the liquid level of liquid metal in a mold, the height of the slag above the liquid metal, the variation of the thickness of the solidified slag that surrounds the cast metal object, the smelting speed, and other parameters which must be monitored if an intelligent control of the process as a whole is to be exercised.

Finally, it is an object of the present invention to provide such a method and apparatus, which will be relatively simple and inexpensive, easy to operate or perform, and, in the case of the apparatus, rugged and durable in use.

Briefly, the objects of the invention are achieved by passing a coolant fluid in indirect heat exchange with the molten metal undergoing casting or refining, as well as the same metal after it has solidified, and with any slag that surmounts the molten metal, and continuously monitoring the temperature, not of the mold walls as in the prior art, but rather of the moving coolant, so that a continuous measurement is obtained, not of the temperature of the molten or solidified metal or slag, but rather of the heat emitted by the same. The heat flow from the solidified and the molten metal and the slag tends to vary sharply at the interfaces between these regions, in a way that the mere temperature may not; and so the locations of these regions within the sleeve can be more accurately determined.

In a preferred embodiment of the invention, the coolant is passed in a continuous helical path that extends axially on both sides of the region of the molten metal, and the temperature of the coolant in each of the turns of the helix is continuously monitored.

As a result of this continuous monitoring, it is possible to construct a continuous profile of the quantity of heat leaving each point along the region that extends axially on both sides of the molten metal. The level of the molten metal can be detected, because it transfers substantially more heat to the coolant than does, say, the slag above it. Thus, even if the slag and the molten metal were at the same temperature, there would still be a sharp change in the temperature readings of the coolant adjacent the liquid metal and adjacent the slag. Similarly, the coefficient of heat transfer of the molten metal being substantially different from that of the solidified metal, and also having regard for the negative heat of solidification of the molten metal, the position of the molten metal and the solid metal relative to each other can be readily determined. Also, the thickness of the solidified slag that surrounds the solidified metal can also be monitored, because of its insulating properties.

As a result, the necessary information is easily derived, to enable control of various parameters of the process, such as power supplied to the electrodes in the case of ESR, the rate of movement of the ingot mold and the ingot relative to each other, the rate of coolant flow, and so on, so as to permit optimum control of the metallurgical process in question.

An embodiment of apparatus according to the present invention, useful for example in the ESR process, will now be described, in connection with the accompanying drawing, which is a somewhat schematic cross-sectional representation of apparatus according to the invention.

In the drawing, there is shown an arrangement for cladding a cylindrical ingot with metal, according to the ESR process. The ingot 1 passes axially through an annular ingot mold of the so-called "T-type". Of course, the mold may have any of a variety of other known configurations. A metal layer 2 is continuously and progressively clad to the ingot 1, in a cylindrical sheath thereabout. To this end, the mold 3 has a least inside diameter which exceeds the diameter of the ingot 1 by twice the thickness of the cladding 2.

The mold 3 is hollow and is divided into a plurality of continuous interconnected helical turns 4', 4'', 4''' and 4$^{IV}$, which are at least ten in number but are shown to be of a lesser number in the drawing for clarity of illustration. A continuous helicoidal baffle 5 delineates the various turns.

Into each turn of the helicoidal passageway thus provided, is inserted a thermoelement 6 in the form of a known thermocouple or thermoresistance element. Each thermoelement 6 is connected to a recording circuit of known type, which accordingly is not shown. Each thermoelement 6 thus registers a continuous trace, for example, on conventional recording means.

During the ESR process or continuous casting, as the product and the mold move with axial relative movement, the coolant, e.g. water, in each turn of the helical passageway within the mold will absorb a certain quantity of heat which is a function of the enthalpy and conductivity of the material adjacent the material in contact with the mold, that is, the solidified metal, the molten metal or the slag. Of course the coolant moves with sufficient speed through the helical passageway and in sufficient volume that it never boils.

In the zones 4' above the slag bath 7, the heat absorption by the coolant is practically nil. In the zones 4'' in registry with the slag bath 7, heat absorption will be to some extent proportional to the power supplied to the electrode or electrodes 8 which, at least in the case of the ESR process, can be hollow as shown for the supply of powdered materials to the melt zone. In the zones 4''', in registry with the liquid metal 9, the heat absorption by the coolant will reach its maximum, owing to the higher thermoconductivity of liquid metal, and also to the negative heat of solidification of the metal. In the lowermost zones $4^{IV}$, heat absorption will gradually decrease and will chiefly be a function of and vary to some extent with the thickness of the layer of solidified slag between the solidified metal and the ingot mold.

It will thus be seen that although the different zones may be at temperatures which are not indicative of the nature of the zone, the heat emitted by the zone will be, by comparison, quite distinctive of that zone, and so the locations of the various zones, i.e. the solidified metal, the molten metal and any slag, can be precisely and reliably determined by comparison of the continuous readings of each thermoelement.

Also, if for any reason the power supplied to the electrodes 8 should vary, then the amount of heat transmitted to the zones 4'' will promptly vary; and a still further possibility of process control is thus afforded.

From a consideration of the foregoing disclosure, therefore, it will be evident that all of the initially recited objects of the present invention have been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. Apparatus for the continuous monitoring of a continuous metallurgical process characterized in that a body of molten metal continuously solidifies to increase the length in one direction of a body of solidified metal, comprising an annular cooling jacket to surround said bodies of molten metal and solidified metal, means for passing a cooling fluid through said jacket in a helical path, and means for measuring the temperature of said coolant fluid at each of a plurality of turns of the helix.

2. Apparatus as claimed in claim 1, said temperature measuring means being spaced radially outwardly of the inner side wall of said jacket.

3. Apparatus as claimed in claim 1, in which said helix has at least 10 turns.

4. A method for the continuous monitoring of a continuous metallurgical process in which a body of molten metal continuously solidifies to increase the length in one direction of a body of solidified metal, comprising passing a known flow of coolant fluid in indirect heat exchange with said molten and solidified metal in a helical path that surrounds said molten and solidified metal and extends for a substantial distance on opposite sides of said molten metal, and continuously measuring the temperature of said coolant fluid at each of a plurality of turns of the helix.

5. A method as claimed in claim 4, in which said helix has at least 10 turns.

6. A method as claimed in claim 4, in which said temperature measurement is performed in said turns of the helix at points spaced radially outwardly from the inner sides of the helix.

7. A method as claimed in claim 4, in which said coolant fluid is a liquid.

8. A method as claimed in claim 7, in which said liquid is water.

* * * * *